US006561119B1

(12) United States Patent
Rigitano

(10) Patent No.: US 6,561,119 B1
(45) Date of Patent: May 13, 2003

(54) TRAFFIC DIRECTING WAND

(76) Inventor: Steven Rigitano, 10260 Milford, Westchester, IL (US) 60154

( * ) Notice: Subject to any disclaimer, the term of this patent is extended or adjusted under 35 U.S.C. 154(b) by 0 days.

(21) Appl. No.: 09/186,253

(22) Filed: Nov. 5, 1998

(51) Int. Cl.[7] ..... G08G 9/00
(52) U.S. Cl. ..... 116/63 P; 116/173; 40/586
(58) Field of Search ..... 116/63 P, 63 R, 116/35 R, 28 R, 173; 40/586, 583

(56) References Cited

U.S. PATENT DOCUMENTS 2,881,543 A * 4/1959 DeRouen ..... 116/173
3,091,215 A * 5/1963 Kenmore ..... 116/173
3,334,554 A * 8/1967 Adams ..... 116/63 P
3,802,378 A * 4/1974 Kessler ..... 116/63 P
3,952,690 A * 4/1976 Rizzo et al. ..... 116/63 P
4,038,552 A * 7/1977 Ciofalo ..... 116/63 P
5,001,455 A * 3/1991 Starchevich ..... 40/586
5,009,019 A * 4/1991 Erlendsson et al. ..... 40/583
5,276,424 A * 1/1994 Hegemann ..... 40/586
5,483,917 A * 1/1996 Walker ..... 116/63 P
5,729,926 A * 3/1998 Cowgill et al. ..... 116/63 P
5,832,867 A * 11/1998 Whicker, Jr. ..... 116/63 P
6,003,256 A * 12/1999 Leach et al. ..... 116/63 P

* cited by examiner

*Primary Examiner*—Diego Gutierrez
*Assistant Examiner*—Stanley J. Pruchnic, Jr.
(74) *Attorney, Agent, or Firm*—Susan L. Lukasik

(57) ABSTRACT

A traffic directing wand for directing traffic in lighted conditions such as in the day and in low light conditions such as in the night. The traffic directing wand includes a paddle and a handle. The paddle has first and second faces, and an outer perimeter comprising top and bottom edges, and a pair of side edges extending between the top and bottom edges of the paddle. The handle has upper and lower ends, and an exterior side. The bottom edge of the paddle is coupled to the upper end of the handle. The first face of the paddle has an orange colored surface for aiding the visibility of the first face of the paddle. The second face of the paddle has a phosphorescent surface for aiding the visibility of the second face of the paddle in low light conditions.

11 Claims, 3 Drawing Sheets

TRAFFIC DIRECTING WAND

BACKGROUND OF THE INVENTION

1. Field of the Invention

The present invention relates to traffic directing wands and more particularly pertains to a new traffic directing wand for directing traffic in lighted conditions such as in the day and in low light conditions such as in the night.

2. Description of the Prior Art

The use of traffic directing wands is known in the prior art. More specifically, traffic directing wands heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,483,917; U.S. Pat. No. 3,580,659; U.S. Pat. No. 3,787,675; U.S. Pat. No. 5,642,931; U.S. Pat. No. 3,114,143; and U.S. Pat. No. 881,264.

While these devices fulfill their respective, particular objectives and requirements, the aforementioned patents do not disclose a new traffic directing wand. The inventive device includes a paddle and a handle. The paddle has first and second faces, and an outer perimeter comprising top and bottom edges, and a pair of side edges extending between the top and bottom edges of the paddle. The handle has upper and lower ends, and an exterior side. The bottom edge of the paddle is coupled to the upper end of the handle. The first face of the paddle has an orange colored surface for aiding the visibility of the first face of the paddle. The second face of the paddle has a phosphorescent surface for aiding the visibility of the second face of the paddle in low light conditions.

In these respects, the traffic directing wand according to the present invention substantially departs from the conventional concepts and designs of the prior art, and in so doing provides an apparatus primarily developed for the purpose of directing traffic in lighted conditions such as in the day and in low light conditions such as in the night.

SUMMARY OF THE INVENTION

In view of the foregoing disadvantages inherent in the known types of traffic directing wands now present in the prior art, the present invention provides a new traffic directing wand construction wherein the same can be utilized for directing traffic in lighted conditions such as in the day and in low light conditions such as in the night.

The general purpose of the present invention, which will be described subsequently in greater detail, is to provide a new traffic directing wand apparatus and method which has many of the advantages of the traffic directing wands mentioned heretofore and many novel features that result in a new traffic directing wand which is not anticipated, rendered obvious, suggested, or even implied by any of the prior art traffic directing wands, either alone or in any combination thereof.

To attain this, the present invention generally comprises a paddle and a handle. The paddle has first and second faces, and an outer perimeter comprising top and bottom edges, and a pair of side edges extending between the top and bottom edges of the paddle. The handle has upper and lower ends, and an exterior side. The bottom edge of the paddle is coupled to the upper end of the handle. The first face of the paddle has an orange colored surface for aiding the visibility of the first face of the paddle. The second face of the paddle has a phosphorescent surface for aiding the visibility of the second face of the paddle in low light conditions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new traffic directing wand apparatus and method which has many of the advantages of the traffic directing wands mentioned heretofore and many novel features that result in a new traffic directing wand which is not anticipated, rendered obvious, suggested, or even implied by any of the prior art traffic directing wands, either alone or in any combination thereof.

It is another object of the present invention to provide a new traffic directing wand which may be easily and efficiently manufactured and marketed.

It is a further object of the present invention to provide a new traffic directing wand which is of a durable and reliable construction.

An even further object of the present invention is to provide a new traffic directing wand which is susceptible of a low cost of manufacture with regard to both materials and labor, and which accordingly is then susceptible of low prices of sale to the consuming public, thereby making such traffic directing wand economically available to the buying public.

Still yet another object of the present invention is to provide a new traffic directing wand which provides in the apparatuses and methods of the prior art some of the advantages thereof, while simultaneously overcoming some of the disadvantages normally associated therewith.

Still another object of the present invention is to provide a new traffic directing wand for directing traffic in lighted conditions such as in the day and in low light conditions such as in the night.

Yet another object of the present invention is to provide a new traffic directing wand which includes a paddle and a handle. The paddle has first and second faces, and an outer perimeter comprising top and bottom edges, and a pair of side edges extending between the top and bottom edges of the paddle. The handle has upper and lower ends, and an exterior side. The bottom edge of the paddle is coupled to the upper end of the handle. The first face of the paddle has an orange colored surface for aiding the visibility of the first face of the paddle. The second face of the paddle has a phosphorescent surface for aiding the visibility Of the second face of the paddle in low light conditions.

Still yet another object of the present invention is to provide a new traffic directing wand that may be used to direct airplanes at an airport.

Even still another object of the present invention is to provide a new traffic directing wand that does not need batteries to provide luminescence.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
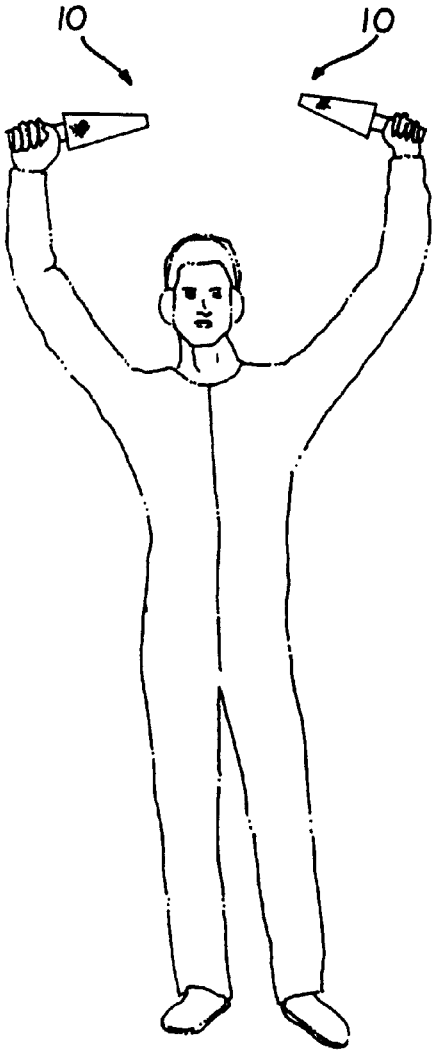
FIG. 1 is a schematic front side view of a pair of new traffic directing wands in use according to the present invention.
Figure 2:
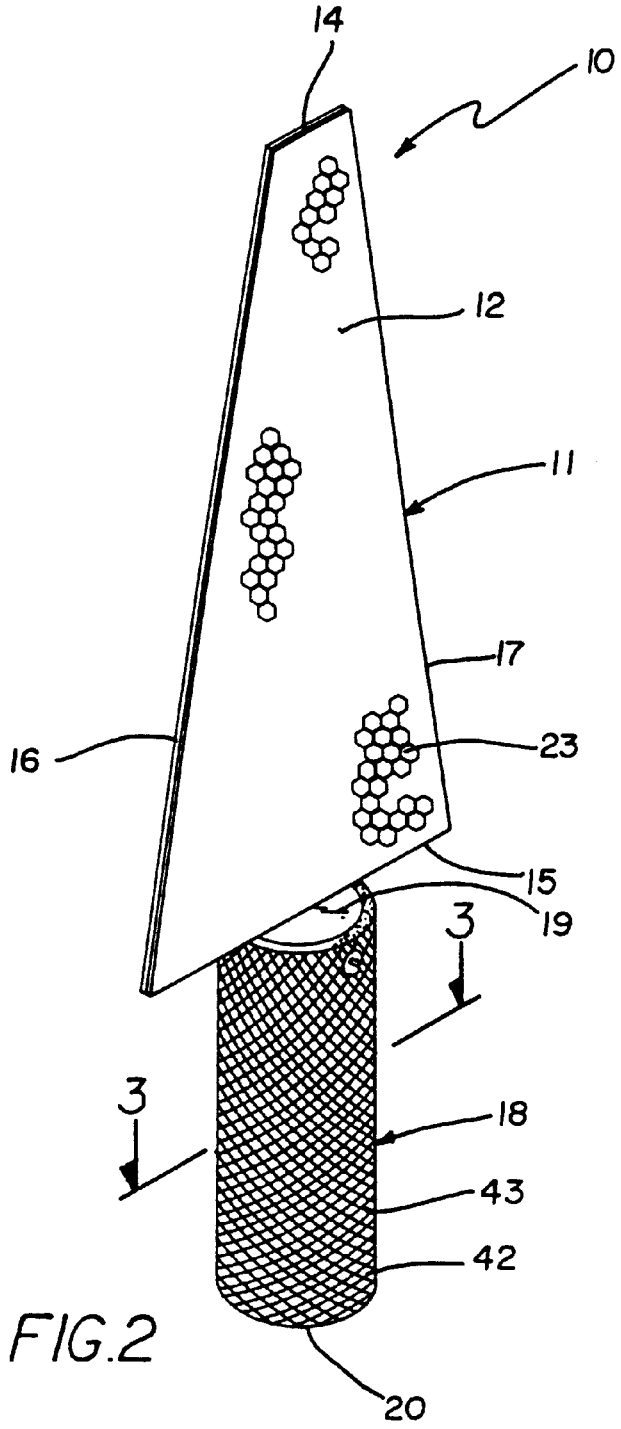
FIG. 2 is a schematic perspective view of the first face of the paddle of the present invention.

With reference now to the drawings, and in particular to FIGS. 1 through 7 thereof, a new traffic directing wand embodying the principles and concepts of the present invention and generally designated by the reference numeral 10 will be described.

As best illustrated in FIGS. 1 through 6, the traffic directing wand 10 generally comprises a paddle 11 and a handle 18. The paddle 11 has first and second faces 12,13, and an outer perimeter comprising top and bottom edges 14,15, and a pair of side edges 16,17 extending between the top and bottom edges 14,15 of the paddle 11. The handle 18 has upper and lower ends 19,20, and an exterior side 21. The bottom edge 15 of the paddle 11 is coupled to the upper end 19 of the handle 18. The first face 12 of the paddle 11 has an orange colored surface for aiding the visibility of the first face 12 of the paddle 11. The second face 13 of the paddle 11 has a phosphorescent surface for aiding the visibility of the second face 13 of the paddle 11 in low light conditions.

In closer detail, the paddle 11 has generally planar first and second faces 12,13, and a generally trapezoidal outer perimeter comprising generally straight top and bottom edges 14,15, and a pair of generally straight side edges 16,17 extending between the top and bottom edges 14,15 of the paddle 11. The top and bottom edges 14,15 of the paddle 11 are extended generally parallel to one another. The side edges 16,17 of the paddle 11 converge towards the top edge 14 of the paddle 11.

Figure 3:
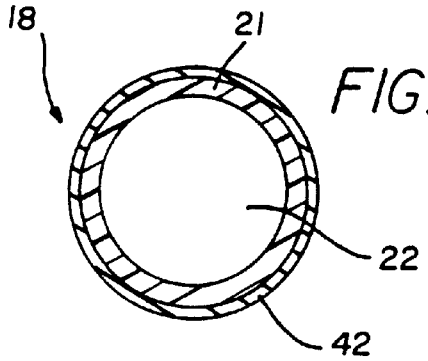
FIG. 3 is a schematic cross sectional view of the handle of the present invention taken from line 3—3 of FIG. 2.
Figure 4:
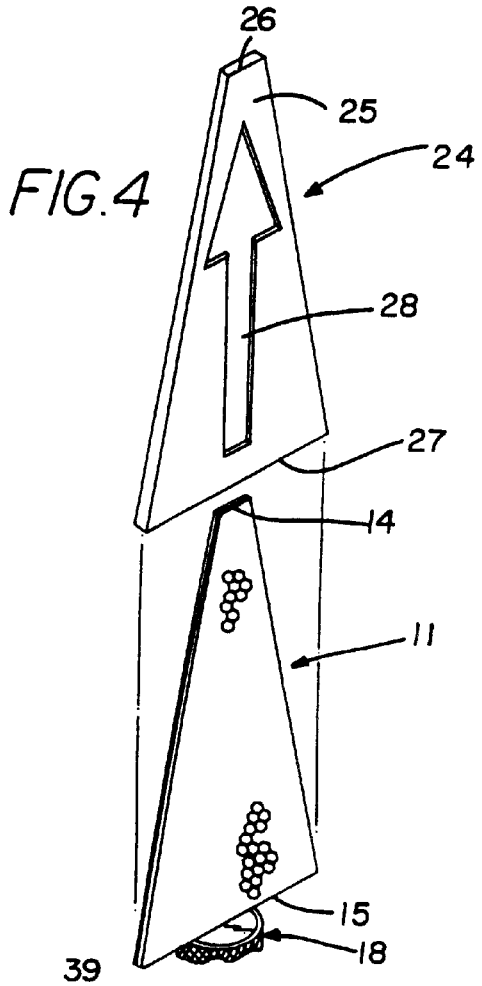
FIG. 4 is a schematic exploded perspective view of the sleeve and paddle of the present invention.
Figure 5:
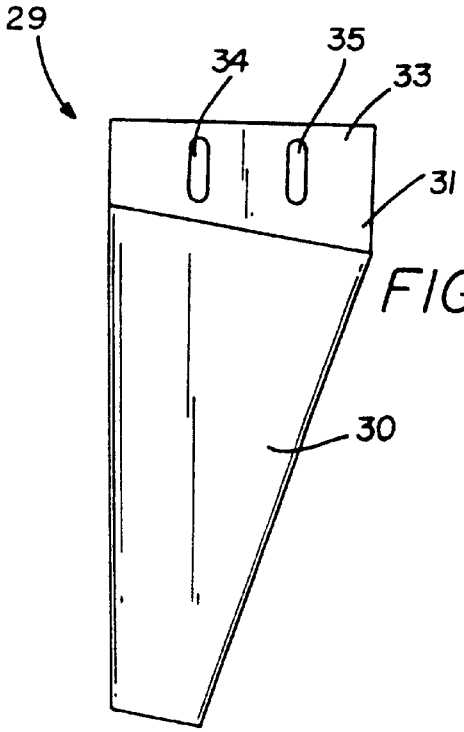
FIG. 5 is a schematic side view of the holster of the present invention.
Figure 6:
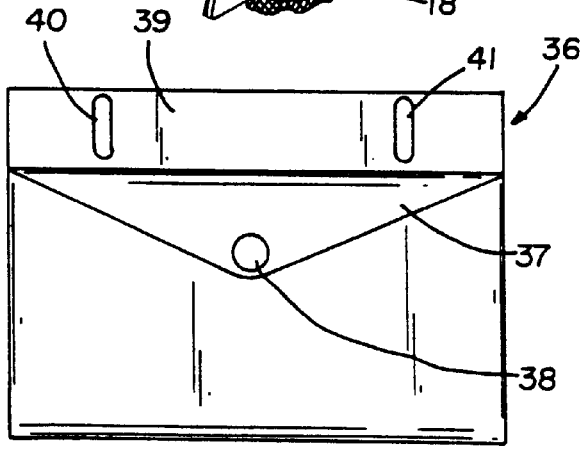
FIG. 6 is a schematic side view of the pouch of the present invention.
Figure 7:
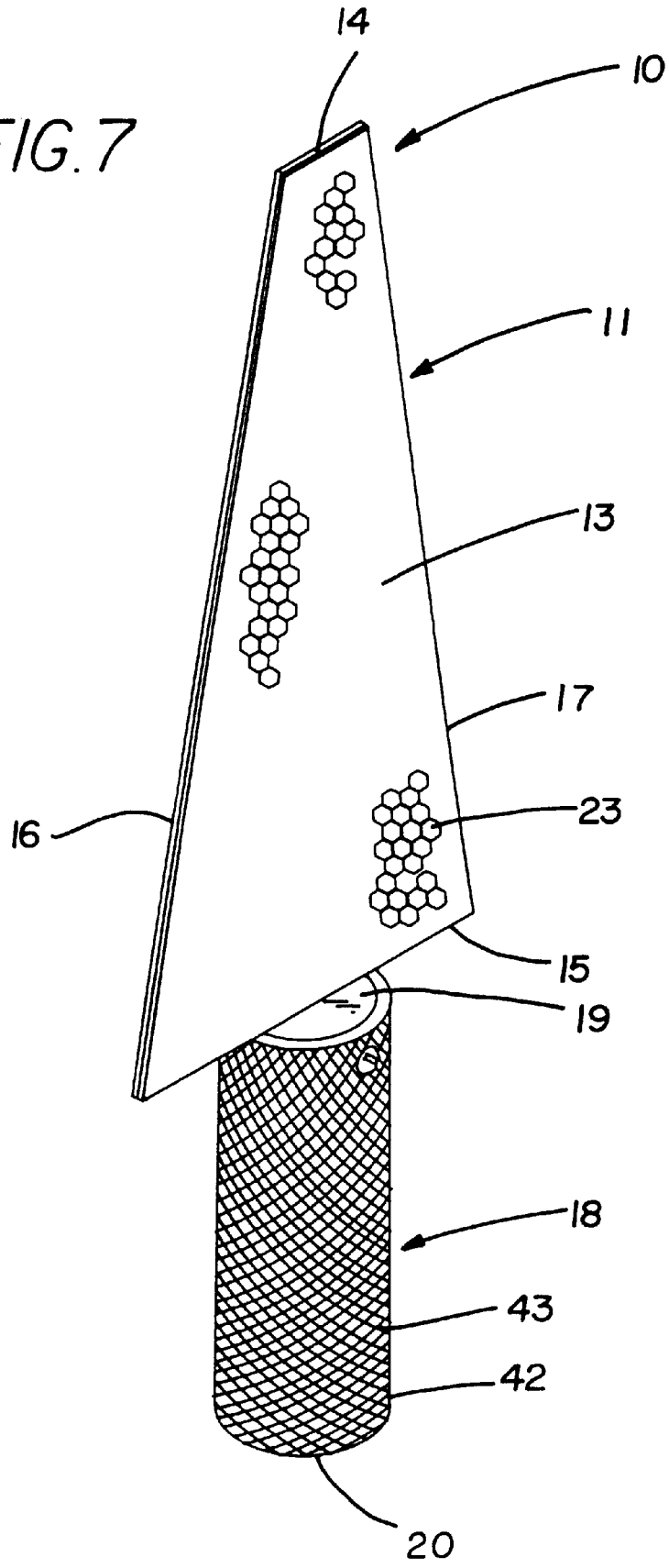
FIG. 7 is a schematic perspective view of the second face of the paddle of the present invention.

The generally cylindrical handle 18 has generally circular upper and lower ends 19,20, a generally cylindrical exterior side 21 and a center axis extending between the upper and lower ends 19,20 of the handle 18. The bottom edge 15 of the paddle 11 is coupled to the upper end 19 of the handle 18. Preferably, the paddle 11 and the central axis of the handle 18 generally lie in a common plane with one another. As illustrated in FIG. 3, the handle 18 ideally comprises a tube having a hollow interior 22 or lumen for reducing the overall weight of the handle 18. The handle 18 preferably has a resiliently compressible outer layer 42 substantially covering the exterior side 21 of the handle 18. Ideally, the resiliently compressible outer layer 42 of the handle 18 comprises a resiliently compressible rubber material. The resiliently compressible outer layer 42 of the handle 18 preferably has a plurality of grooves 43 arranged in a grid forming a plurality of generally diamond shaped regions. The grooves 43 of the resiliently compressible outer layer 42 frictionally enhance the exterior side 21 of the handle 18 with respect to a generally smooth surface for aiding the grip of a user holding the handle 18.

The first face 12 of the paddle 11 has a fluorescent orange colored surface for aiding the visibility of the first face 12 of the paddle 11. The orange colored surface of the first face 12 substantially covers the first face 12 of the paddle 11. The first face 12 of the paddle 11 may comprise an orange colored material such as an orange colored plastic to provide the orange colored surface of the first face 12 of the paddle 11 or the orange colored surface may comprise an orange colored coating such as an orange paint on the first face 12 of the paddle 11.

The second face 13 of the paddle 11 has a phosphorescent surface for aiding the visibility of the second face 13 of the paddle 11 in low light conditions. The phosphorescent surface of the second face 13 of the paddle 11 substantially covers the second face 13 of the paddle 11. The second face 13 of the paddle 11 may comprise a phosphorescent material to provide the phosphorescent surface or a phosphorescent coating may be applied on to the second face 13 of the paddle 11. Ideally, the phosphorescent surface of the second face 13 of the paddle 11 is orange colored. Optionally, the surfaces of the first and second faces 12,13 both comprise light refracting hexes 23.

The paddle 11 has a length defined between the top and bottom edges 14,15 of the paddle 11, a top width defined between the side edges 16,17 of the paddle 11 at the top edge 14 of the paddle 11, and a bottom width defined between the side edges 16,17 of the paddle 11 at the bottom edge 15 of the paddle 11. The handle 18 has a length defined between the upper and lower ends 19,20 of the handle 18, and an outer diameter transverse the center axis of the handle 18. Preferably, the length of the paddle 11 is greater than about two times the length of the handle 18. In an ideal illustrative embodiment, the length of the paddle 11 is about 7¾ inches, the top width of the paddle 11 is about 1½ inches, and the bottom width of the paddle 11 is about 2½ inches. In this ideal illustrative embodiment, the length of the handle 18 is about 3 inches for providing sufficient area for a user to grasp the handle 18, and an outer diameter of about 1½ inches for providing a comfortable grip to the user.

Also provided as part of the system is at least one sleeve 24 with a generally trapezoidal outer perimeter and a pair of panels 25 coupled together along the outer perimeter of the sleeve 24 to define a generally trapezoidal space therebetween. The sleeve 24 has top and bottom ends 26,27, the bottom end 27 has a slit into the space of the sleeve 24. The paddle 11 is inserted into the space of the sleeve 24 through the slit of the bottom end 27 of the sleeve 24. At least one of panels 25 of the sleeve 24 has a cutout 28 providing an opening into the space of the sleeve 24. The cutout 28 of the panel of the sleeve 24 preferably has a generally arrow-shaped periphery although the periphery of the cutout may be any desired shape. The cutout 28 of the panel of the sleeve 24 permits viewing of an adjacent face of the paddle 11 therethrough.

A holster 29 may be provided having a generally trapezoidal outer perimeter and front and back panels 30,31 coupled together along the outer perimeter of the holster 29. The front and back panels 30,31 of the holster 29 define a pocket therebetween having a top opening therein designed for receiving the paddle 11 therein. The back panel 31 of the holster 29 has an upwardly extending top flap 33. The top flap 33 of the back panel 31 of the holster 29 has a spaced apart pair of slots 34,35 designed for extending a belt of a user therethrough to attach the holster 29 to the belt of the user.

The system also preferably includes a pouch 36 with a cover flap 37 covering an opening into the pouch 36 and secured to the pouch with a snap fastener 38. The pouch 36 is designed for receiving the sleeve 24 therein when the sleeve is not in use. The pouch 36 has an upwardly extending upper flap 39. The upper flap 39 of the pouch 36 has a spaced apart pair of apertures 40,41 therethrough designed for extending a belt of a user therethrough to attach the pouch 36 to the belt of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A traffic directing wand system, comprising:

a paddle having first and second faces, and an outer perimeter comprising top and bottom edges, and a pair of side edges extending between said top and bottom edges of said paddle;

a handle having upper and lower ends, and an exterior side;

said bottom edge of said paddle being coupled to said upper end of said handle;

said first face of said paddle having an orange colored surface for aiding the visibility of said first face of said paddle;

said second face of said paddle having a phosphorescent surface for aiding the visibility of said second face of said paddle in low light conditions;

at least one sleeve having an outer perimeter and a pair of panels coupled together along said outer perimeter of said sleeve to define a space therebetween, said sleeve having top and bottom ends, said bottom end having a slit into said space of said sleeve, said paddle being inserted into said space of said sleeve through said slit of said bottom end of said sleeve;

wherein one of said panels of said sleeve has a cutout providing an opening into said space of said sleeve, said cutout of said panel of said sleeve having a periphery in a shape of a symbol corresponding to an instruction for permitting viewing of an adjacent face of said paddle therethrough such that said instruction is communicated to a viewer of said paddle.

2. The traffic directing wand system of claim 1, wherein said outer perimeter of said paddle is generally trapezoidal, said top and bottom edges of said paddle being extended generally parallel to one another, said side edges of said paddle converging towards said top edge of said paddle.

3. The traffic directing wand system of claim 1, wherein said handle is generally cylindrical and has a center axis extending between said upper and lower ends of said handle, said paddle and said central axis of said handle generally lying in a common plane with one another.

4. The traffic directing wand system of claim 1, wherein said handle comprises a tube having a hollow interior.

5. The traffic directing wand system of claim 1, wherein said handle has a resiliently compressible outer layer substantially covering said exterior side of said handle.

6. The traffic directing wand system of claim 5, wherein said resiliently compressible outer layer of said handle has a plurality of grooves arranged in a grid forming a plurality of generally diamond shaped regions, said grooves of said resiliently compressible outer layer frictionally enhancing said exterior side of said handle with respect to a generally smooth surface for aiding the grip of a user holding said handle.

7. The traffic directing wand system of claim 1, wherein said paddle has a length defined between said top and bottom edges of said paddle, wherein said handle has a length defined between said upper and lower ends of said handle, wherein said length of said paddle is greater than about two times said length of said handle.

8. The traffic directing wand system of claim 1, wherein said periphery of said cutout of said panel of said sleeve is generally arrow shaped to communicate a directional instruction.

9. The traffic directing wand system of claim 1, further comprising a pouch having a cover flap covering an opening into said pouch, said pouch being adapted for receiving said sleeve therein, said pouch having an upwardly extending upper flap, said upper flap of said pouch having a spaced apart pair of apertures therethrough adapted for extending a belt of a user therethrough to attach said pouch to the belt of the user.

10. The traffic directing wand system of claim 1, further comprising a holster having an outer perimeter and front and back panels coupled together along said outer perimeter of said holster, said front and back panels of said holster defining a pocket therebetween having a top opening therein adapted for receiving said paddle therein, said back panel of said holster having an upwardly extending top flap, said top flap of said back panel of said holster having a spaced apart pair of slots adapted for extending a belt of a user therethrough to attach said holster to the belt of the user.

11. A traffic directing wand system, comprising:

a paddle having generally planar first and second faces, and a generally trapezoidal outer perimeter comprising generally straight top and bottom edges, and a pair of generally straight side edges extending between said top and bottom edges of said paddle;

said top and bottom edges of said paddle being extended generally parallel to one another, said side edges of said paddle converging towards said top edge of said paddle;

a generally cylindrical handle having generally circular upper and lower ends, a generally cylindrical exterior side and a center axis extending between said upper and lower ends of said handle;

said bottom edge of said paddle being coupled to said upper end of said handle, said paddle and said central axis of said handle generally lying in a common plane with one another;

said handle comprising a tube having a hollow interior for reducing a weight of said handle;

said handle having a resiliently compressible outer layer substantially covering said exterior side of said handle, wherein said resiliently compressible outer layer of said handle comprises a resiliently compressible rubber material;

said resiliently compressible outer layer of said handle has a plurality of grooves arranged in a grid forming a plurality of generally diamond shaped regions, said grooves of said resiliently compressible outer layer frictionally enhancing said exterior side of said handle with respect to a generally smooth surface for aiding the grip of a user holding said handle;

said first face of said paddle having an orange colored surface for aiding the visibility of said first face of said paddle, said orange colored surface of said first face substantially covering said first face of said paddle;

said second face of said paddle having a phosphorescent surface for aiding the visibility of said second face of said paddle in low light conditions, said phosphorescent surface of said second face of said paddle substantially covering said second face of said paddle;

wherein said phosphorescent surface of said second face of said paddle is orange colored;

wherein said surfaces of said first and second faces both comprise a light refracting material;

wherein said paddle has a length defined between said top and bottom edges of said paddle, wherein said handle has a length defined between said upper and lower ends of said handle, wherein said length of said paddle is greater than about two times said length of said handle;

said paddle having a top width defined between said side edges of said paddle at said at said top edge of said paddle, said paddle having a bottom width defined between said side edges of said paddle at said bottom edge of said paddle;

wherein said length of said paddle is about 7¾ inches, said top width of said paddle being about 1½ inches, said bottom width of said paddle being about 2½ inches;

wherein said length of said handle is about 3 inches for providing sufficient area for a user to grasp said handle, an outer diameter of about 1½ inches for providing a comfortable grip to the user;

at least one sleeve having a generally trapezoidal outer perimeter and a pair of panels coupled together along said outer perimeter of said sleeve to define a generally trapezoidal space therebetween, said sleeve having top and bottom ends, said bottom end having a slit into said space of said sleeve;

said paddle being inserted into said space of said sleeve through said slit of said bottom end of said sleeve;

one of panels of said sleeve having a cutout providing an opening into said space of said sleeve, said cutout of said panel of said sleeve having a periphery in a shape of a symbol corresponding to an instruction for permitting viewing of an adjacent face of said paddle therethrough such that said instruction is communicated to a viewer of said paddle;

wherein said periphery of said cutout of said panel of said sleeve is generally arrow-shaped to communicate a directional instruction;

a holster having a generally trapezoidal outer perimeter and front and back panels coupled together along said outer perimeter of said holster, said front and back panels of said holster defining a pocket therebetween having a top opening therein adapted for receiving said paddle therein, said back panel of said holster having an upwardly extending top flap, said top flap of said back panel of said holster having a spaced apart pair of slots adapted for extending a belt of a user therethrough to attach said holster to the belt of the user; and a pouch having a cover flap covering an opening into said pouch, said pouch being adapted for receiving said sleeve therein, said pouch having an upwardly extending upper flap, said upper flap of said pouch having a spaced apart pair of apertures therethrough adapted for extending a belt of a user therethrough to attach said pouch to the belt of the user.

* * * * *